US006554577B2

(12) United States Patent
Park et al.

(10) Patent No.: US 6,554,577 B2
(45) Date of Patent: Apr. 29, 2003

(54) APPARATUS AND METHOD FOR CONTROLLING OPERATION OF LINEAR COMPRESSOR USING PATTERN RECOGNITION

(75) Inventors: Joon Hyung Park, Seoul (KR); Yin Young Hwang, Anyang (KR); Jin Koo Park, Gwangmyeong (KR); Yang Kyu Kim, Seoul (KR); Se Young Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/989,413

(22) Filed: Nov. 21, 2001

(65) Prior Publication Data

US 2002/0064462 A1 May 30, 2002

(30) Foreign Application Priority Data

Nov. 29, 2000 (KR) ..... 00-71655

(51) Int. Cl.[7] ..... F04B 49/06

(52) U.S. Cl. ..... 417/44.1; 417/53; 417/45; 417/18; 417/44.11; 417/417; 417/212

(58) Field of Search ..... 417/53, 44.1, 45, 417/18, 44.11, 212, 417

(56) References Cited

U.S. PATENT DOCUMENTS 5,947,693 A * 9/1999 Yang ..... 417/45
5,980,211 A * 11/1999 Tojo et al. ..... 417/45
6,084,320 A * 7/2000 Morita et al. ..... 310/12
6,153,951 A * 11/2000 Morita et al. ..... 310/12
6,176,683 B1 * 1/2001 Yang ..... 417/44.1
6,231,310 B1 * 5/2001 Tojo et al. ..... 417/44.1
6,289,680 B1 * 9/2001 Oh et al. ..... 62/6

* cited by examiner

*Primary Examiner*—Charles G. Freay
*Assistant Examiner*—William Rodriquez
(74) *Attorney, Agent, or Firm*—Birch, Stewart, Kolasch & Birch, LLP

(57) ABSTRACT

An apparatus and a method for controlling operation of a linear compressor uses a pattern recognition for operating a compressor at an optimum efficiency by recognizing a trace in a graph about relation between a current and a displacement as a pattern and sensing variation of the pattern. The apparatus for controlling operation of the linear compressor using a pattern recognition includes a displacement calculating unit calculating a displacement by being inputted the current detected in the current detecting unit and the voltage detected in the voltage detecting unit, a pattern recognition unit being inputted the displacement outputted from the displacement calculating unit and the current outputted from the current detecting unit and detecting a pattern by using a trace corresponding to the displacement and the current, a stroke controlling unit being inputted a pattern from the pattern recognition unit and outputting a switching control signal according to the inputted pattern, and an electric circuit unit being inputted the switching control signal outputted from the stroke controlling unit and outputting a certain voltage to the linear compressor. Accordingly, it is possible to perform a TDC control of a piston considering an error due to non-linearity characteristics, improve an operation efficiency of a linear compressor and have a wide and precise control region.

12 Claims, 4 Drawing Sheets

APPARATUS AND METHOD FOR CONTROLLING OPERATION OF LINEAR COMPRESSOR USING PATTERN RECOGNITION

BACKGROUND OF THE INVENTION

1. Field of the Invention

The present invention relates to an apparatus and a method for controlling operation of a linear compressor which are capable of operating a linear compressor by being inputted a stroke reference value, and in particular to an apparatus and a method for controlling operation of a linear compressor using a pattern recognition which are capable of operating a linear compressor as an optimum efficiency by recognizing relation between a current and a displacement as a pattern.

2. Description of the Prior Art

Generally, a function of a compressor pressurizes a refrigerant vapor to help easier condensing of the refrigerant vapor evaporated in an evaporator. By the operation of the compressor, a refrigerant transports heat from a cold place to a hot place by repeating condensing and evaporating processes while circulating through a refrigerating apparatus.

Recently, various types of compressors are used, and a reciprocating compressor is used in general. The reciprocating compressor uses a method rising a pressure by pressurizing vapor by a piston moving up and down inside a cylinder, particularly when the reciprocating compressor is used for a refrigerator or an air conditioner, a compression ratio can be varied by varying a stroke voltage applied to the reciprocating compressor, accordingly it is advantageous to a variable refrigerating capacity control.

However, because the reciprocating compressor compresses vapor by converting a rotation motion of a motor into a linear motion, mechanical converting apparatus such as a screw, a chain, a gear system and a timing belt, etc. for converting the rotation motion into the linear motion are essential. Accordingly, because energy loss due to the conversion is large and a structure of the apparatus is intricate, recently a linear compressor using a linear method in which a motor itself performs a linear motion is used.

The linear compressor does not require mechanical converting apparatus by directly generating a linear operation force by a motor itself, has a simple structure, reduces loss due to energy conversion and largely decreases a noise by not including a connection portion caused friction and abrasion. In addition, when the linear compressor is used for a refrigerator or an air conditioner, a compression ratio can be varied by varying a stroke voltage applied to the linear compressor, accordingly it is advantageous to a variable refrigerating capacity control.

FIG. 1 is a block diagram illustrating a construction of an apparatus for controlling operation of a linear compressor in accordance with the conventional art. As depicted in FIG. 1, an apparatus for controlling operation of a linear compressor includes a linear compressor 3 adjusting a refrigerating capacity by varying a stroke (a distance between a top dead center and a bottom dead center of a piston) with a reciprocating motion of a piston by a stroke voltage, a current detecting unit 5 detecting a current applied to the linear compressor 3 by the variation of the stroke, a voltage detecting unit 7 detecting a voltage generated in the linear compressor 3 by the variation of the stroke, a microcomputer 9 calculating a stroke by using the current and the voltage detected from the current detecting unit 5 and the voltage detecting unit 7 and outputting a switching control signal by comparing the calculated stroke with a stroke reference value inputted by a user, and an electric circuit unit 1 intermitting AC power by the outputted switching control signal and applying a stroke voltage to the linear compressor.

The control operation of the conventional linear compressor will be described.

First, by the stroke reference value set by the user, the electric circuit unit 1 outputs a stroke voltage, the piston performs a linear motion by the stroke voltage, according to it the stroke (a distance between a top dead center and a bottom dead center) is varied, accordingly the refrigerating capacity of the linear compressor 3 is controlled.

In more detail, in the linear compressor 3, the stroke is varied by the linear motion of the piston of the cylinder, the refrigerating gas inside the cylinder is transmitted to a condenser through a discharge valve, accordingly the refrigerating capacity is adjusted.

Herein, when the stroke is varied by the stroke value, the current detecting unit 5 and the voltage detecting unit 7 detect the voltage and the current generated in the linear compressor 3, and the microcomputer 9 calculates the stroke by using the detected voltage and the current.

In addition, when the calculated stroke is smaller than the stroke reference value, the microcomputer 9 increases a stroke voltage applied to the linear compressor 3 by outputting a switching control signal lengthening an on cycle of a triac, as described, when the calculated stroke is larger than the stroke reference value, the microcomputer 9 outputs a switching control signal shortening an on cycle of triac, accordingly the stroke value applied to the linear compressor 3 is decreased.

However, because the conventional apparatus has a serious non-linearity in the mechanical motion characteristics, it is impossible to perform a precise control with the linear control method not considering the non-linearity.

SUMMARY OF THE INVENTION

Accordingly, it is an object of the present invention to provide an apparatus and a method for controlling operation of a linear compressor using a pattern recognition which are capable of controlling a TDC (top dead center) by considering an error due to non-linearity characteristics and improving an operation efficiency of a linear compressor.

In order to achieve the above-mentioned object, an apparatus for controlling operation of a linear compressor includes a current detecting unit 20 detecting a current applied to a linear compressor, a voltage detecting unit 30 detecting a voltage generated in the linear compressor, a displacement calculating unit 40 calculating a displacement by being inputted the current detected in the current detecting unit and the voltage detected in the voltage detecting unit, a pattern recognition unit 50 being inputted the displacement outputted from the displacement calculating unit and the current outputted from the current detecting unit and detecting a pattern by using a trace corresponded to the displacement and the current, a stroke controlling unit 60 being inputted a pattern from the pattern recognition unit 50 and outputting a switching control signal according to the inputted pattern, and an electric circuit unit 10 being inputted the switching control signal outputted from the stroke controlling unit 60 and outputting a certain voltage to the linear compressor 11.

In order to achieve the above-mentioned object, a method for controlling operation of a linear compressor includes detecting a current and a voltage generated in the operation of the linear compressor 11, calculating and outputting a displacement by using the detected current and the voltage, detecting a pattern by using a trace corresponded to the calculated displacement and the detected current, comparing the detected pattern with a reference pattern and outputting a switching control signal when they coincide with each other, and operating the linear compressor 11 by applying the stroke voltage to the linear compressor according to the switching control signal.

DETAILED DESCRIPTION OF THE PREFERRED EMBODIMENT

Figure 1:
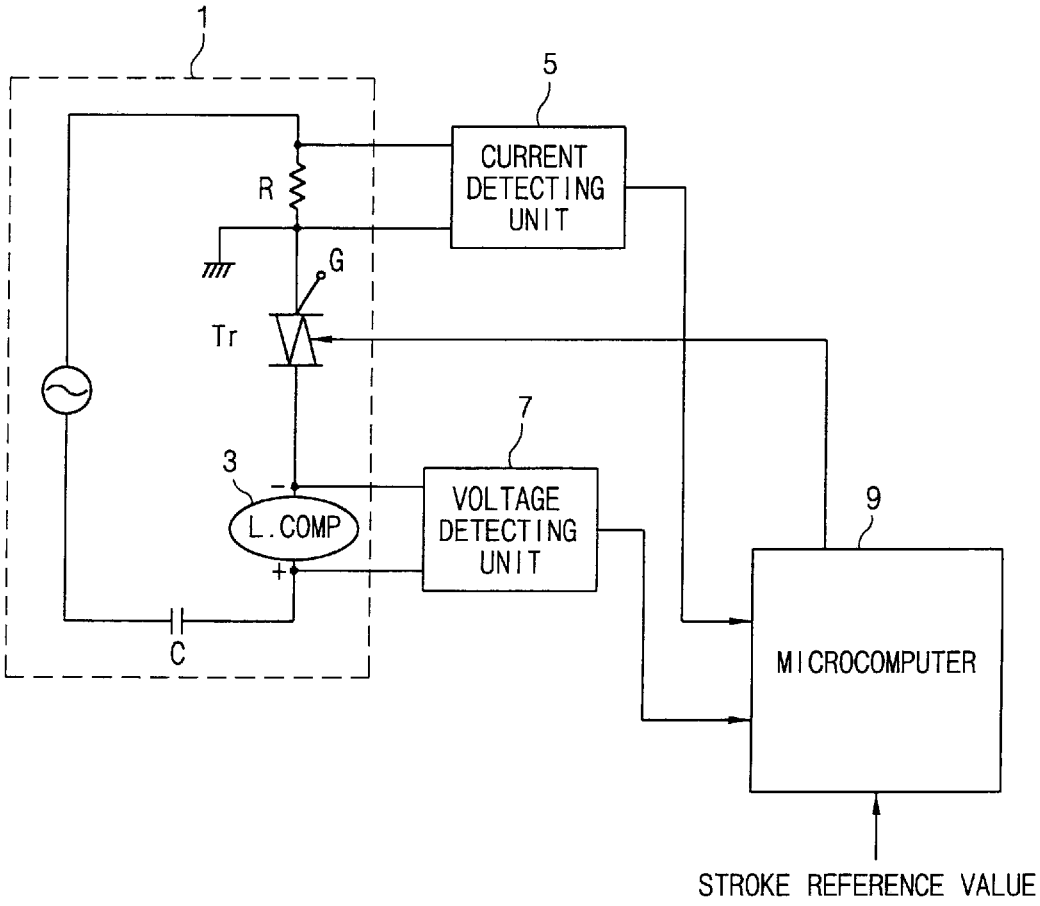
FIG.1 CONVENTIONAL ART
FIG. 1 is a block diagram illustrating a construction of an apparatus for controlling operation of a linear compressor in accordance with the conventional art.
Figure 2:
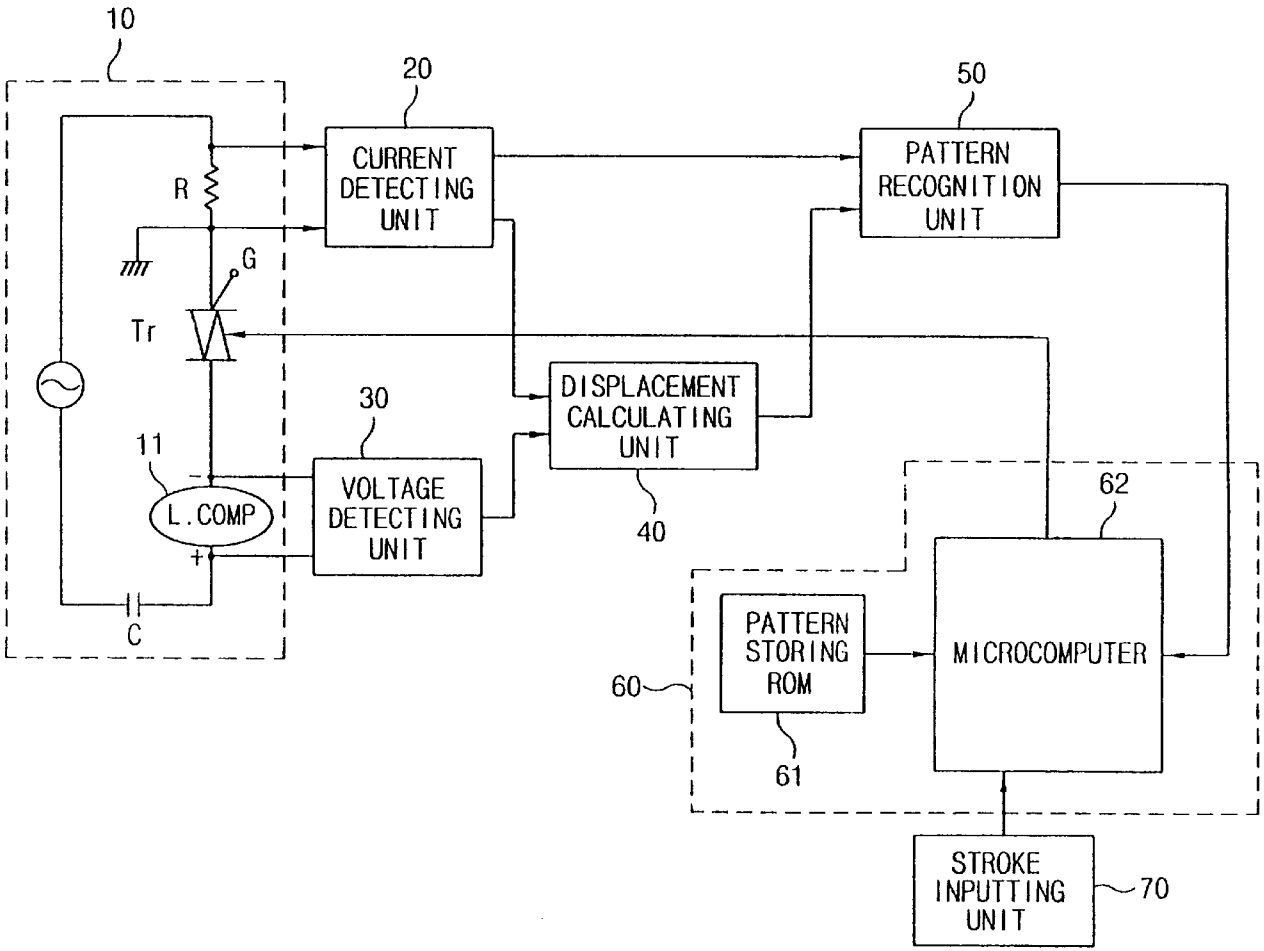
FIG. 2 is a block diagram illustrating a construction of an apparatus for controlling operation of a linear compressor in accordance with the present invention.

FIG. 2 is a block diagram illustrating a construction of an apparatus for controlling operation of a linear compressor in accordance with the present invention, as depicted in FIG. 2, an apparatus for controlling operation of a linear compressor includes a current detecting unit 20 detecting a current applied to a linear compressor, a voltage detecting unit 30 detecting a voltage generated in the linear compressor, a displacement calculating unit 40 calculating a displacement by being inputted the current detected in the current detecting unit and the voltage detected in the voltage detecting unit, a pattern recognition unit 50 being inputted the displacement outputted from the displacement calculating unit and the current outputted from the current detecting unit and detecting a pattern by using a trace corresponded to the displacement and the current, a stroke controlling unit 60 being inputted a pattern from the pattern recognition unit 50 and outputting a switching control signal according to the inputted pattern, and an electric circuit unit 10 being inputted the switching control signal outputted form the stroke controlling unit 60 and outputting a certain voltage to the linear compressor 11.

Herein, the stroke controlling unit 60 includes a pattern storing ROM 61 pre-storing a reference pattern corresponded to a current and a displacement when a TDC is '0' and a microcomputer 62 being inputted the reference pattern of the pattern storing ROM 61 and a certain pattern outputted from the pattern recognition unit 50, comparing them and outputting a switching control signal according to the comparison, and the electric circuit unit 10 includes a triac being inputted the switching control signal outputted from the stroke controlling unit 60, intermitting AC (alternating current) power and applying the stroke voltage to the linear compressor 11.

In addition, the pattern recognition unit 50 detects a pattern by detecting which cell includes the trace corresponded to the current and the displacement in a plurality of cells constructed by using the current and the displacement, the stroke controlling unit 60 outputs a switching control signal by comparing the detected pattern with the reference pattern outputted from the pattern storing ROM 61, and the linear compressor 11 adjusts the refrigerating capacity by varying the stroke with the linear motion of the piston by the stroke voltage corresponded to the switching control signal.

The operation of the apparatus for controlling operation of the linear compressor 11 in accordance with the present invention will be described.

First, the linear compressor 11 generates the stroke voltage according to the stroke reference value inputted by the user, the piston performs the linear motion by the stroke voltage, and the stroke is varied according to it, accordingly the refrigerating capacity is adjusted. In more detail, by lengthening the turn on cycle of the triac of the electric circuit unit according to the switching control signal of the microcomputer 62, the stroke is increased, and the linear compressor 11 is operated by the stroke.

Herein, the current detecting unit 20 and the voltage detecting unit 30 respectively detect the voltage and the current generated in the linear compressor 11, apply them to the displacement calculating unit 40, according to it the displacement calculating unit 40 calculates a displacement by using the voltage detected in the voltage detecting unit 30 and the current detected in the current detecting unit 20 and outputs it.

Herein, the pattern recognition unit 50 recognizes a trace of a graph corresponded to the current and the displacement as a pattern by being inputted the displacement of the displacement calculating unit 40 and the current of the current detecting unit 20, in more detail, by constructing a plurality of cells, the pattern recognition unit 50 detects which cell includes a trace corresponded to the current and the displacement. Herein, the pattern storing ROM pre-stores a current in TDC as '0' and a pattern about a trace corresponded to a displacement as a reference pattern.

After, the microcomputer 62 is inputted the reference pattern of the pattern storing ROM 61 and a certain pattern outputted from the pattern recognition unit, compares them outputs a switching control signal according to the comparison result, and the linear compressor 11 adjusts the refrigerating capacity by varying the stroke with the linear motion of the piston by the stroke voltage corresponded to the switching control signal.

Figure 3:
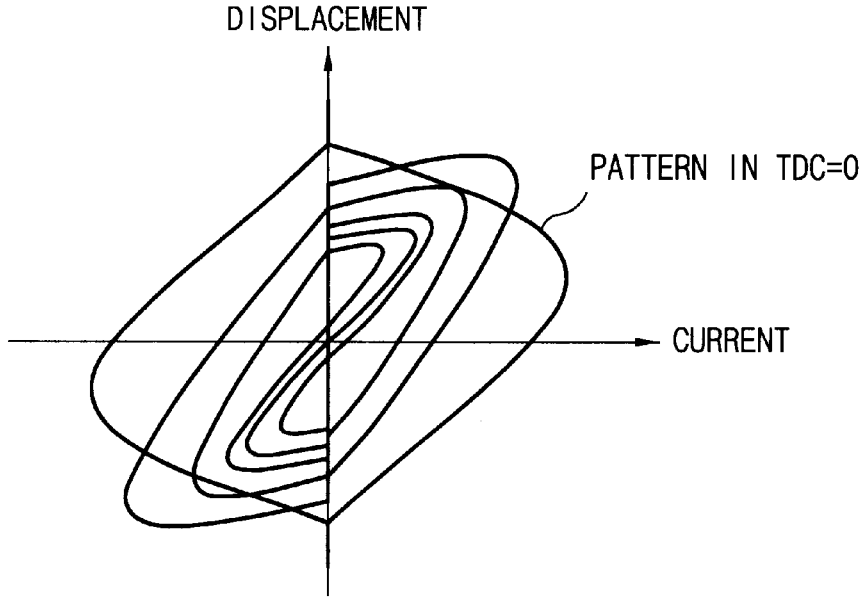
FIG. 3 is a graph illustrating a pattern corresponded to a current and a displacement according to a duty ratio increase of a switching control signal.

FIG. 3 is a graph illustrating a pattern corresponded to a current and a displacement according to a duty ratio increase of a switching control signal. It illustrates the pattern when a TDC is "0" in a trace placed at the most external angle.

In more detail, by calculating the displacement with the current consumed in the operation of the linear compressor 11 and a sensorless circuit, a trace varied corresponded to the current and the displacement can be obtained. Herein, while the switching control signal applied to the triac of the electric circuit unit is increased, a varying trace is obtained and recognized as a pattern, when the pattern coincides with the reference pattern in which the TDC is '0', the operation of the linear compressor is controlled by controlling the on/off cycle of the triac with a switching control signal at that point.

Figure 4:
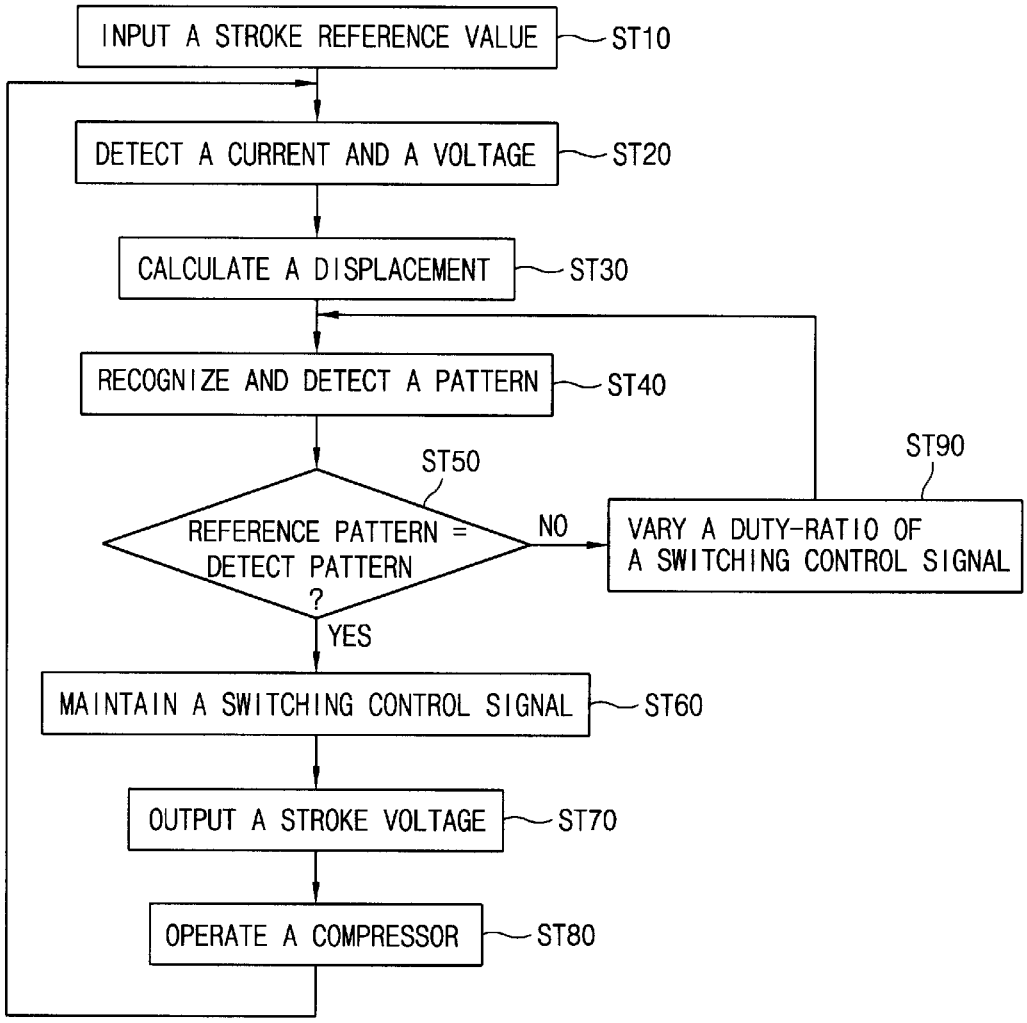
FIG. 4 is a flow chart illustrating a method for controlling operation of a linear compressor in accordance with the present invention.

FIG. 4 is a flow chart illustrating a method for controlling operation of a linear compressor in accordance with the present invention. The method for controlling operation of the linear compressor in accordance with the present invention includes outputting a stroke reference value by an input of a user as shown at step ST10, detecting a current and a voltage generated in the operation of the linear compressor 11 by the stroke voltage as shown at step ST20, calculating a displacement by using the detected current and voltage and outputting it as shown at ST30, detecting a pattern by using the calculated displacement and a trace corresponded to the detected current as shown at step ST40, maintaining and outputting the switching control signal when the detected pattern and the reference pattern coincide with each other in comparison as shown at steps ST50–ST60, increasing a duty-ratio of the switching control signal when the detected pattern and the reference pattern do not coincide with each other in the comparison as shown at step ST90, and operating the linear compressor 11 by applying the stroke voltage to the linear compressor 11 by intermitting the AC power with the triac according to the switching control signal as shown at steps ST70–ST80.

In more detail, until the reference pattern in TDC as '0' coincides with the certain pattern outputted from the pattern recognition unit, the microcomputer 62 increases the duty-ratio of the switching control signal, outputs a pattern according to the increase of the duty-ratio, when the reference pattern and the certain pattern coincide with each other, maintains the switching control signal at the point and outputs it. According to it, the electric circuit unit 10 intermits the AC power with the triac according to the switching control signal to the microcomputer, applies the stroke voltage to the linear compressor and controls the operation of the linear compressor.

As described above, the apparatus and the method for controlling operation of the linear compressor using the pattern recognition in accordance with the present invention are capable of performing a TDC control of a piston considering an error due to non-linearity characteristics and improving an operation efficiency of a linear compressor by detecting a pattern between an input current and a displacement in order to detect non-linearity characteristics due to mechanical characteristics and controlling a stroke by using the detected pattern.

What is claimed is:

1. An apparatus for controlling operation of a linear compressor, comprising:

a current detecting unit detecting a current applied to a linear compressor;

a voltage detecting unit detecting a voltage generated in the linear compressor;

a displacement calculating unit calculating a displacement by being inputted the current detected in the current detecting unit and the voltage detected in the voltage detecting unit;

a pattern recognition unit being inputted the displacement outputted from the displacement calculating unit and the current outputted from the current detecting unit and detecting a pattern by using a trace corresponding to the displacement and the current;

a stroke controlling unit being inputted the pattern from the pattern recognition unit and outputting a switching control signal according to the inputted pattern; and an electric circuit unit being inputted the switching control signal outputted from the stroke controlling unit and outputting a constant voltage to the linear compressor.

2. The apparatus of claim 1, further comprising:

a stroke inputting unit outputting a certain stroke reference value by an input of a user.

3. The apparatus of claim 1, wherein the linear compressor adjusts a refrigerating capacity by varying a stroke with a linear motion of a piston according to a stroke voltage.

4. The apparatus of claim 1, wherein the pattern recognition unit recognizes a pattern by detecting which cell includes the trace corresponding to the current and the displacement in a plurality of cells constructed by using the current and the displacement.

5. The apparatus of claim 1, wherein the stroke controlling unit includes:

a pattern storing ROM pre-storing a reference pattern corresponding to a current and a displacement when a TDC is '0'; and a microcomputer being inputted the reference pattern of the pattern storing ROM and a certain pattern outputted from the pattern recognition unit, comparing them and outputting a switching control signal according to the comparison result.

6. The apparatus of claim 5, wherein the microcomputer varies a duty-ratio of the switching control signal until the reference pattern in which the TDC is '0' coincides with a certain pattern outputted from the pattern recognition unit and controls the operation of the linear compressor by maintaining a switching control signal at a point in which the reference pattern and the certain pattern coincide with each other.

7. The apparatus of claim 1, wherein the electric circuit unit includes a triac being inputted the switching control signal outputted from the stroke controlling unit, intermitting AC (alternating current) power and applying the stroke voltage to the linear compressor.

8. The apparatus of claim 7, wherein the stroke voltage is controlled by varying an on/off cycle of the triac according to the switching control signal of the microcomputer.

9. A method for controlling operation of a linear compressor, comprising:

outputting a stroke reference value by an input of a user;

detecting a current and a voltage generated in the operation of the linear compressor by a stroke voltage;

calculating a displacement by using the detected current and voltage and outputting it;

detecting a pattern by using the calculated displacement and a trace corresponding to the detected current;

being inputted the detected pattern and outputting a switching control signal when the inputted pattern coincides with the reference pattern in comparison; and operating the compressor by applying the stroke voltage to the linear compressor by intermitting AC power with a triac according to the switching control signal.

10. The method of claim 9, further comprising:

varying a duty-ratio of the switching control signal when the detected pattern does not coincide with the reference pattern in comparison in the switching control signal outputting step.

11. The method of claim 9, wherein the reference pattern is a pattern about a trace corresponding to a current and a displacement when a TDC is '0' in the switching control signal outputting step.

12. The method of claim 9, wherein the switching control signal controls the on/off cycle of the triac by outputting a switching control signal when a TDC of the reference pattern is '0' in the compressor operating step.

* * * * *